US010718068B2

(12) United States Patent
Ke et al.

(10) Patent No.: US 10,718,068 B2
(45) Date of Patent: Jul. 21, 2020

(54) METHOD FOR MANUFACTURING COMPOSITE FIBER OF CHARRED VINASSE AND SHELL

(71) Applicants: Han-Che Ke, Changhua County (TW); Yu-Cheng Ke, Changhua County (TW)

(72) Inventors: Han-Che Ke, Changhua County (TW); Yu-Cheng Ke, Changhua County (TW)

( * ) Notice: Subject to any disclaimer, the term of this patent is extended or adjusted under 35 U.S.C. 154(b) by 290 days.

(21) Appl. No.: 15/922,055

(22) Filed: Mar. 15, 2018

(65) Prior Publication Data

US 2018/0282906 A1 Oct. 4, 2018

(30) Foreign Application Priority Data

Mar. 28, 2017 (TW) ..... 106110223 A

(51) Int. Cl.

| | |
|---|---|
| ***D01F 6/62*** | (2006.01) |
| ***D01D 5/08*** | (2006.01) |
| ***D01F 9/08*** | (2006.01) |
| ***D01F 1/10*** | (2006.01) |
| ***D01F 1/09*** | (2006.01) |
| ***D01F 9/10*** | (2006.01) |

(52) U.S. Cl.

CPC ..... *D01F 6/62* (2013.01); *D01D 5/08* (2013.01); *D01F 1/09* (2013.01); *D01F 1/10* (2013.01); *D01F 9/08* (2013.01); *D01F 9/10* (2013.01)

(58) Field of Classification Search

CPC ..... D01F 6/62; D01F 1/09; D01F 1/10; D01F 1/103; D01F 9/08; D01F 9/10

See application file for complete search history.

(56) References Cited

U.S. PATENT DOCUMENTS

2011/0200776 A1* 8/2011 Zikeli ..... C08K 3/26 428/36.9

FOREIGN PATENT DOCUMENTS

GB 347144 A * 4/1931 ..... D01F 2/28
KR 20050090225 A * 9/2005

OTHER PUBLICATIONS

Translation of KR 20050090225 (Year: 2005).*

* cited by examiner

*Primary Examiner* — Xiao S Zhao
*Assistant Examiner* — John J Derusso
(74) *Attorney, Agent, or Firm* — Muncy, Geissler, Olds & Lowe, P.C.

(57) ABSTRACT

A method for manufacturing composite fiber of charred vinasse and shell includes steps of: charring a vinasse raw material at 800 to 1000 degrees Celsius to form a charred vinasse material, washing a shell raw material and charring the shell raw material at 1000 to 1400 degrees Celsius to form a charred shell material; mixing the charred vinasse material and the charred shell material in a weight ratio of 60-70:40-30 to form a mixed material, grinding the mixed material, mixing the mixed material and polyester granules in a weight ratio of 10-16:90-84, melting and granulating the mixed material and polyester granules to form primary granules; mixing and melting the primary granules and polyester granules in a weight ratio of 5-20:95-80 and granulating to form mixed granules; melting the mixed granules to spin into a composite fiber.

8 Claims, 2 Drawing Sheets

METHOD FOR MANUFACTURING COMPOSITE FIBER OF CHARRED VINASSE AND SHELL

BACKGROUND OF THE INVENTION

Field of the Invention

The present invention relates to a method for manufacturing composite fiber.

Description of the Prior Art

Polyester fiber is widely used because of the good strength, flexibility, quick-drying, and difficulty of wrinkling Thus, polyester fiber is often spun with other plastic fiber to form functional cloth.

However, polyester fiber is disadvantageous in bad function of moisture adsorption and warming. In addition, it generates static often, and it's unable to bear high temperature. Besides, polyester fiber is completely man-made and not environment-friendly.

SUMMARY OF THE INVENTION

The main object of the present invention is to provide a method for manufacturing composite fiber of charred vinasse and shell in order to provide composite fiber which is environment-friendly, anti-oxidation, warm, and anti-static.

To achieve the above and other objects, the method for manufacturing composite fiber of charred vinasse and shell of the present invention includes the following steps.

Prepare charred vinasse material and charred shell material: Char a vinasse raw material at 800 to 1000 degrees Celsius to form a charred vinasse material. Wash a shell raw material and char the shell raw material at 1000 to 1400 degrees Celsius to form a charred shell material.

Prepare primary granule: Mix the charred vinasse material and the charred shell material in a weight ratio of 60-70:40-30 to form a mixed material. Grind the mixed material. Mix the mixed material and first polyester granules in a weight ratio of 10-16:90-84. Melt and granulate the mixed material and the first polyester granules to form primary granules.

Prepare mixed granules: Mix and melt the primary granules and second polyester granules in a weight ratio of 5-20:95-80 and granulating to form mixed granules.

Spinning: Melt the mixed granules to spin into a composite fiber.

To achieve the above and other objects, another method for manufacturing composite fiber of charred vinasse and shell of the present invention includes the following steps.

Prepare charred vinasse material and charred shell material: Char a vinasse raw material at 800 to 1000 degrees Celsius to form a charred vinasse material. Wash a shell raw material and char the shell raw material at 1000 to 1400 degrees Celsius to form a charred shell material.

Prepare primary granule: Mix the charred vinasse material and the charred shell material in a weight ratio of 60-70:40-30 to form a mixed material. Grind the mixed material. Mix the mixed material and first polyester granules in a weight ratio of 10-16:90-84. Melt and granulate the mixed material and the first polyester granules to form primary granules.

Mixing, melting, and spinning: Mix and melt the primary granules and second polyester granules in a weight ratio of 5-20:95-80 followed by spinning into a composite fiber.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
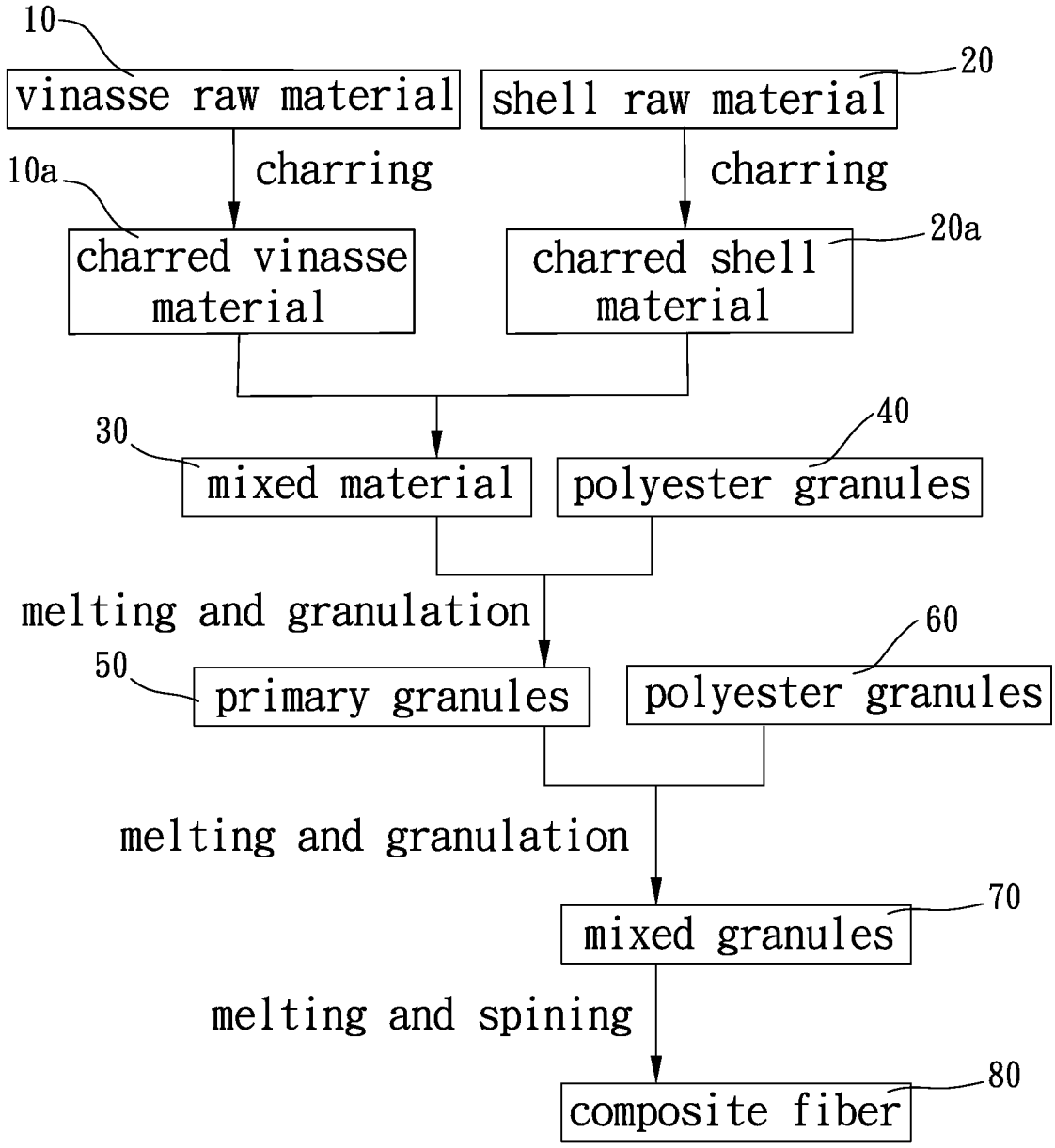
FIGS. 1 and 2 are flow charts of the present invention.

Please refer to FIG. 1, the method for manufacturing composite fiber of charred vinasse and shell of the present invention includes the following steps.

Prepare charred vinasse material and charred shell material: Char a vinasse raw material 10 at 800 to 1000 degrees Celsius to form a charred vinasse material 10*a*. Wash a shell raw material 20 and char the shell raw material 20 at 1000 to 1400 degrees Celsius to form a charred shell material 20*a*. Preferably, the shell raw material 20 can be selected from oyster shell or clam shell and is composed of over 90 wt % of calcium carbonate.

Prepare primary granule: Mix the charred vinasse material 10*a* and the charred shell material 20*a* in a weight ratio of 60-70:40-30 to form a mixed material 30. Grind the mixed material 30. Mix the mixed material 30 and first polyester granules 40 in a weight ratio of 10-16:90-84. Melt and granulate the mixed material 30 and the first polyester granules 40 to form primary granules 50. Preferably, the mixed material 30 and the first polyester granules 40 are mixed in a weight ratio of 16:84.

Prepare mixed granules: Mix and melt the primary granules 50 and second polyester 60 granules in a weight ratio of 5-20:95-80 and granulating to form mixed granules 70. Preferably, the mixed granules 70 are composed of 0.8 wt % to 2.0 wt % of said mixed material 30.

Spinning: Melt the mixed granules 70 to spin into a composite fiber 80.

Figure 2:
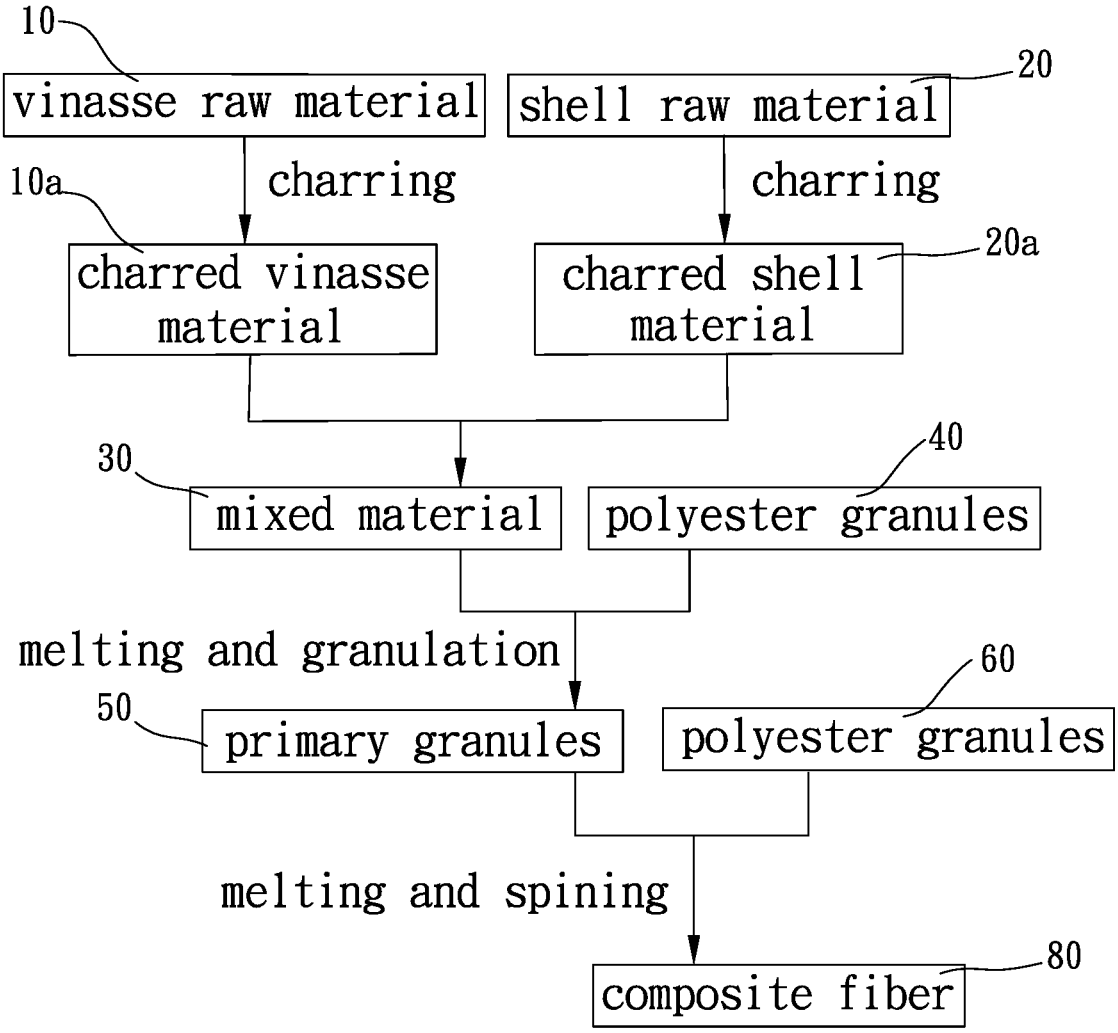

Please refer to FIG. 2, in another embodiment of the present invention, the method for manufacturing composite fiber of charred vinasse and shell includes the following steps.

Prepare charred vinasse material and charred shell material: Char a vinasse raw material 10 at 800 to 1000 degrees Celsius to form a charred vinasse material 10*a*. Wash a shell raw material 20 and char the shell raw material 20 at 1000 to 1400 degrees Celsius to form a charred shell material 20*a*. Preferably, the shell raw material 20 can be selected from oyster shell or clam shell and is composed of over 90 wt % of calcium carbonate.

Prepare primary granule: Mix the charred vinasse material 10*a* and the charred shell material 20*a* in a weight ratio of 60-70:40-30 to form a mixed material 30. Grind the mixed material 30. Mix the mixed material 30 and first polyester granules 40 in a weight ratio of 10-16:90-84. Melt and granulate the mixed material 30 and the first polyester granules 40 to form primary granules 50. Preferably, the mixed material 30 and the first polyester granules 40 are mixed in a weight ratio of 16:84.

Mixing, melting, and spinning: Mix and melt the primary granules and second polyester granules in a weight ratio of 5-20:95-80 followed by spinning into a composite fiber.

Preferably, the composite fiber 80 is composed of 0.8 wt % to 2.0 wt % of said mixed material 30.

That is, the primary granules and the second polyester granules can be mixed to form the mixed granules for storing, and the mixed granules are melted and spun into the composite fiber if needed. However, the primary granules and the second polyester granules can be melted and spun into the composite fiber directly too.

In conclusion, the present invention transfers waste vinasse and shell into composite fiber whose quality is better than polyester fiber. In addition, the composite fiber of the present invention is deodorant, antimicrobial, moisture adsorbing, anti-oxidation, and warm. Besides, it's also advantageous in physical strength and flexibility.

What is claimed is:

1. A method for manufacturing composite fiber of charred vinasse and shell, including steps of:

preparing a charred vinasse material and a charred shell material: charring a vinasse raw material at 800 to 1000 degrees Celsius to form the charred vinasse material, washing a shell raw material and charring the shell raw material at 1000 to 1400 degrees Celsius to form the charred shell material;

preparing primary granules: mixing the charred vinasse material and the charred shell material in a weight ratio of 60-70:40-30 to form a mixed material, grinding the mixed material, mixing the mixed material and first polyester granules in a weight ratio of 10-16:90-84, melting and granulating the mixed material and the first polyester granules to form the primary granules; preparing mixed granules: mixing and melting the primary granules and second polyester granules in a weight ratio of 5-20:95-80 and granulating to form the mixed granules; spinning: melting the mixed granules to spin into a composite fiber.

2. The method for manufacturing composite fiber of charred vinasse and shell of claim 1, wherein during the step of preparing primary granules, the mixed material and first polyester granules are mixed in a weight ratio of 16:84.

3. The method for manufacturing composite fiber of charred vinasse and shell of claim 1, wherein the mixed granules are composed of 0.8 wt % to 2.0 wt % of said mixed material.

4. The method for manufacturing composite fiber of charred vinasse and shell of claim 1, wherein the shell raw material is composed of over 90 wt % of calcium carbonate.

5. A method for manufacturing composite fiber of charred vinasse and shell, including steps of:

preparing a charred vinasse material and a charred shell material: charring a vinasse raw material at 800 to 1000 degrees Celsius to form the charred vinasse material, washing a shell raw material and charring the shell raw material at 1000 to 1400 degrees Celsius to form the charred shell material;

preparing primary granules: mixing the charred vinasse material and the charred shell material in a weight ratio of 60-70:40-30 to form a mixed material, grinding the mixed material, mixing the mixed material and first polyester granules in a weight ratio of 10-16:90-84, melting and granulating the mixed material and the first polyester granules to form the primary granules; mixing, melting, and spinning: mixing and melting the primary granules and second polyester granules in a weight ratio of 5-20:95-80 followed by spinning into a composite fiber.

6. The method for manufacturing composite fiber of charred vinasse and shell of claim 5, wherein during the step of preparing primary granules, the mixed material and the first polyester granules are mixed in a weight ratio of 16:84.

7. The method for manufacturing composite fiber of charred vinasse and shell of claim 5, wherein the composite fiber is composed of 0.8 wt % to 2.0 wt % of said mixed material.

8. The method for manufacturing composite fiber of charred vinasse and shell of claim 5, wherein the shell raw material is composed of over 90 wt % of calcium carbonate.

* * * * *